US008491088B2

(12) United States Patent
Kobashi et al.

(10) Patent No.: US 8,491,088 B2
(45) Date of Patent: Jul. 23, 2013

(54) MAINTENANCE APPARATUS, LIQUID EJECTING APPARATUS, AND MAINTENANCE METHOD

(75) Inventors: Masaru Kobashi, Matsumoto (JP); Yoshiyuki Kurebayashi, Chiba (JP); Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 88 days.

(21) Appl. No.: 13/112,679

(22) Filed: May 20, 2011

(65) Prior Publication Data

US 2011/0298875 A1 Dec. 8, 2011

(30) Foreign Application Priority Data

Jun. 7, 2010 (JP) ..... 2010-130047

(51) Int. Cl.
*B41J 2/015* (2006.01)

(52) U.S. Cl.
USPC ..... 347/29

(58) Field of Classification Search
USPC ..... 347/29
See application file for complete search history.

(56) References Cited

U.S. PATENT DOCUMENTS

| | | | | |
|---|---|---|---|---|
| 5,774,139 | A * | 6/1998 | Salzer et al. | 347/32 |
| 6,491,369 | B1 * | 12/2002 | Satoh et al. | 347/30 |
| 6,491,370 | B2 * | 12/2002 | Momose | 347/30 |
| 6,508,533 | B2 * | 1/2003 | Tsujimoto et al. | 347/30 |
| 6,550,890 | B2 * | 4/2003 | Saijo | 347/29 |
| 6,565,187 | B2 * | 5/2003 | Karita et al. | 347/29 |
| 6,679,578 | B2 * | 1/2004 | Arakawa | 347/33 |
| 6,722,756 | B2 * | 4/2004 | Choy et al. | 347/29 |
| 7,344,223 | B2 * | 3/2008 | Ishikawa et al. | 347/33 |
| 7,490,921 | B2 * | 2/2009 | Hashi et al. | 347/29 |
| 7,497,544 | B2 * | 3/2009 | Takagi | 347/20 |
| 7,561,248 | B2 * | 7/2009 | Nakano | 355/30 |
| 7,669,999 | B2 * | 3/2010 | Kodama et al. | 347/104 |
| 7,735,956 | B2 * | 6/2010 | Usui et al. | 347/29 |
| 7,753,473 | B2 * | 7/2010 | Nakashima | 347/29 |
| 8,226,204 | B2 * | 7/2012 | Sato | 347/29 |
| 2002/0075348 | A1 * | 6/2002 | Shindo et al. | 347/29 |
| 2002/0130919 | A1 * | 9/2002 | Davis et al. | 347/29 |
| 2002/0130920 | A1 * | 9/2002 | Saijo | 347/31 |
| 2006/0209121 | A1 * | 9/2006 | Yamazaki | 347/29 |
| 2007/0252865 | A1 * | 11/2007 | Sakurai | 347/29 |
| 2007/0279450 | A1 * | 12/2007 | Matsuhashi et al. | 347/29 |
| 2010/0079538 | A1 * | 4/2010 | Ueno | 347/32 |
| 2010/0194819 | A1 * | 8/2010 | Tamaki | 347/29 |

FOREIGN PATENT DOCUMENTS

JP 2005-138313 A 6/2005

* cited by examiner

*Primary Examiner* — Matthew Luu
*Assistant Examiner* — Patrick King
(74) *Attorney, Agent, or Firm* — Workman Nydegger

(57) ABSTRACT

A maintenance apparatus that removes bubbles from a nozzle is provided in a printer that includes a recording head having a nozzle capable of ejecting ink from a nozzle opening formed in a nozzle formation surface. The maintenance apparatus includes: a pressurizing pump that pressurizes the ink in the nozzle in a direction in which the ink is discharged from the nozzle opening; and a contact member having an upper surface that makes contact with the nozzle formation surface so as to cover the nozzle opening, and that has, formed therein, a flow channel whose pressure loss is greater than that of the nozzle and that allows air to pass through from the side of the upper surface. The ink within the nozzle is pressurized by the pressurizing pump in a state in which the contact member is in contact with the nozzle formation surface.

9 Claims, 4 Drawing Sheets

MAINTENANCE APPARATUS, LIQUID EJECTING APPARATUS, AND MAINTENANCE METHOD

CROSS REFERENCES TO RELATED APPLICATIONS

The entire disclosure of Japanese Patent Application No. 2010-130047, filed Jun. 7, 2010, is expressly incorporated by reference herein.

BACKGROUND

1. Technical Field

The present invention relates to maintenance apparatuses, liquid ejecting apparatuses, and maintenance methods.

2. Related Art

Ink jet printers have been widely known for some time as one type of liquid ejecting apparatus that ejects a liquid onto a medium. Such a printer records onto recording paper by ejecting ink (a liquid) from nozzles formed in a liquid ejecting head.

With such a printer, missing dots occur if bubbles enter into the nozzles within the recording head, making it difficult to eject the ink in a favorable manner; this in turn leads to a drop in the recording quality. Accordingly, a cleaning process that forcefully sucks and expels ink, bubbles, and so on from the nozzles of the recording head is executed.

Incidentally, in order to suck ink, bubbles, and so on from nozzles into which bubbles have entered, a suction force that is greater than the suction force sufficient to suck ink from properly-functioning nozzles that are ejecting ink in a favorable manner is necessary. Accordingly, there has been a problem in that when carrying out cleaning using suction, a large amount of ink is expelled from properly-functioning nozzles, resulting in the wasteful consumption of a large amount of ink. Accordingly, a maintenance apparatus that suppresses the consumption of ink during cleaning has been proposed, such as that disclosed in JP-A-2005-138313.

In other words, with the printer according to JP-A-2005-138313, suction cleaning is carried out in a state in which a porous film, through which a liquid can pass, is affixed to the nozzle formation surface of the recording head, the suction being carried out so as to allow air to pass and being carried out at a predetermined pressure. The amount of ink that is expelled during the suction cleaning is regulated by controlling the pressure applied to the recording head, which suppresses the amount of ink that is consumed.

Incidentally, with the maintenance apparatus according to JP-A-2005-138313, in the case where the diameter of the holes formed in the film affixed to the nozzle formation surface is greater than the diameter of the nozzles in the recording head, the pressure loss of the film becomes less than the pressure loss of the nozzles. Accordingly, the suction pressure applied to the nozzle formation surface of the recording head via the film is spread out equally across all of the nozzles, causing ink to be expelled even from the properly-functioning nozzles; this increases the amount of ink that is wastefully consumed.

On the other hand, in the case where the diameter of the holes formed in the film is smaller than the diameter of the nozzles, the pressure loss of the film will become greater than the pressure loss of the nozzles because the film is moistened by the sucked ink. Accordingly, there has been a problem in that the suction pressure applied to the nozzle formation surface via the film drops, which makes it difficult to expel bubbles from the nozzles into which the bubbles have entered.

SUMMARY

An advantage of some aspects of the invention is to provide a maintenance apparatus, a liquid ejecting apparatus, and a maintenance method capable of removing bubbles from the nozzles of a liquid ejecting head with certainty while suppressing the amount of liquid consumed during cleaning.

A maintenance apparatus according to an aspect of the invention is provided in a liquid ejecting apparatus including a liquid ejecting head having a nozzle capable of ejecting a liquid from a nozzle opening formed in a nozzle formation surface, that removes bubbles from within the nozzle, and includes: a pressurizing unit that pressurizes the liquid in the nozzle in a direction in which the liquid is discharged from the nozzle opening; and a flow channel formation member having a contact surface that makes contact with the nozzle formation surface so as to cover the nozzle opening, and that has, formed therein, a flow channel whose pressure loss is greater than the pressure loss of the nozzle and that allows air to pass through from the side of the contact surface. The liquid within the nozzle is pressurized by the pressurizing unit in a state in which the flow channel formation member makes contact with the nozzle formation surface.

According to this configuration, when the liquid within the nozzle is pressurized in the discharge direction by pressurizing unit while the contact surface of the flow channel formation member is in contact with the nozzle formation surface, first, the liquid is discharged into the flow channel formation member from a properly-functioning nozzles, and the discharge of liquid from a nozzle into which bubbles have entered is carried out delaying by the amount of the bubbles. However, because the pressure loss in the flow channel of the flow channel formation member is greater than that of the nozzle opening due to the inflow of liquid, the flow of liquid in the flow channel that corresponds to the properly-functioning nozzle is regulated. Furthermore, because the pressure loss inside the nozzle into which bubbles have entered becomes lower, the bubbles and liquid within the nozzle are discharged. In other words, the pressure from the pressurizing unit can be concentrated on the liquid within the nozzle into which bubbles have entered. In addition, because the flow channel formed in the flow channel formation member is a flow channel that allows air to pass therethrough, the bubbles pass through, whereas the liquid adheres to the flow channel formation member and the pressure loss increases. In other words, when the bubbles are discharged, the flow of liquid is regulated. Accordingly, bubbles can be removed from the nozzle of the liquid ejecting head with certainty while also suppressing the consumption of liquid involved with cleaning.

A maintenance apparatus according to another aspect of the invention further includes a suction unit that sucks the liquid from within the flow channel of the flow channel formation member.

With the pressurizing unit, the flow of liquid is regulated, and thus the liquid that has adhered to the flow channel formation member cannot be discharged. With respect to this, according to this configuration, the liquid that remains within the flow channel of the flow channel formation member can be discharged with ease through the suction, which makes it possible to perform maintenance on the flow channel formation member.

A maintenance apparatus according to another aspect of the invention further includes a cap member that forms to enclose an airtight space between the cap member and the nozzle formation surface by making contact with the liquid ejecting head so as to surround the nozzle opening, and the flow channel formation member is disposed within the cap member.

According to this configuration, because the flow channel formation member is disposed within the cap member, the airtight space region can be formed by bringing the cap member into contact with the liquid ejecting head in a state in which the flow channel formation member, which contains liquid in the flow channel, is in contact with the nozzle formation surface of the liquid ejecting head. Accordingly, the interior of the nozzle can be kept moist due to the liquid contained in the flow channel of the flow channel formation member, which makes it possible to prevent the nozzle from drying out.

In a maintenance apparatus according to another aspect of the invention, the contact surface of the flow channel formation member is configured so that the pressure loss of a gap space region formed between the contact surface and the nozzle formation surface when the contact surface is in contact with the nozzle formation surface is greater than the pressure loss of the nozzle.

According to this configuration, even in the case where the gap space region is formed between the nozzle formation surface of the liquid ejecting head and the contact surface of the flow channel formation member, the pressure loss of the gap space region increases when the liquid discharged from the nozzle of the liquid ejecting head enters into the gap space region; this makes it possible to prevent the liquid from passing through the gap space region. Accordingly, the wasteful consumption of liquid can be suppressed without the liquid that has been pressurized and discharged from the properly-functioning nozzle leaking out from the gap space region. Furthermore, even if the nozzle formation surface of the liquid ejecting head, the flow channel formation member, and so on have changed shape slightly, a gap formed due to those two elements not coming into complete contact with each other and in which the pressure loss increases when liquid enters is permitted, and thus the apparatus will not be rendered unusable due to malformations.

A liquid ejecting apparatus according to another aspect of the invention includes a liquid ejecting head having a nozzle capable of ejecting a liquid from a nozzle opening formed in a nozzle formation surface, and the maintenance apparatus configured as described above.

According to this configuration, the liquid ejecting apparatus can achieve the same effects as those of the stated maintenance apparatus.

A maintenance method according to another aspect of the invention is a maintenance method for a liquid ejecting apparatus that includes a liquid ejecting head having a nozzle capable of ejecting a liquid from a nozzle opening formed in a nozzle formation surface and that employs a maintenance apparatus, the maintenance apparatus including a pressurizing unit that pressurizes the liquid in the nozzle of the liquid ejecting head in a direction in which the liquid is discharged from the nozzle opening and a flow channel formation member having a flow channel whose pressure loss is greater than the pressure loss of the nozzle and that allows air to pass through but regulates the passage of the liquid, and the method including: bringing the flow channel formation member into contact with the nozzle formation surface so as to cover the nozzle opening; expelling the liquid from the nozzle by driving the liquid ejecting head; and discharging the liquid from the nozzle to the flow channel formation member by pressurizing the liquid within the nozzle using the pressurizing unit after the expelling.

According to this configuration, expelling liquid from the nozzle that can expel liquid through the driving of the liquid ejecting head in a step prior to the discharge of liquid from the nozzle performed by the pressurizing unit makes it possible to increase the flow channel resistance of the flow channel in the flow channel formation member that corresponds to the properly-functioning nozzle. Accordingly, bubbles can be eliminated from the nozzle of the liquid ejecting head without applying a high amount of pressure, while further suppressing the consumption of liquid from the properly-functioning nozzle.

BRIEF DESCRIPTION OF THE DRAWINGS

The invention will be described with reference to the accompanying drawings, wherein like numbers reference like elements.

FIG. 2A is an overall cross-sectional view illustrating the pressurizing pump in a pre-pressurized state, and FIG. 2B is an overall cross-sectional view illustrating the pressurizing pump in a pressurized state.

FIG. 3A is an overall cross-sectional view illustrating the configuration of a maintenance apparatus, whereas

FIG. 4A is a schematic cross-sectional view illustrating a state in which a contact member has made contact with the recording head, FIG. 4B is a schematic cross-sectional view illustrating a state in which ink is expelled only from properly-functioning nozzles, and FIG. 4C is a schematic cross-sectional view illustrating a state in which ink is expelled from nozzles into which bubbles have entered.

DESCRIPTION OF EXEMPLARY EMBODIMENTS

Figure 1:
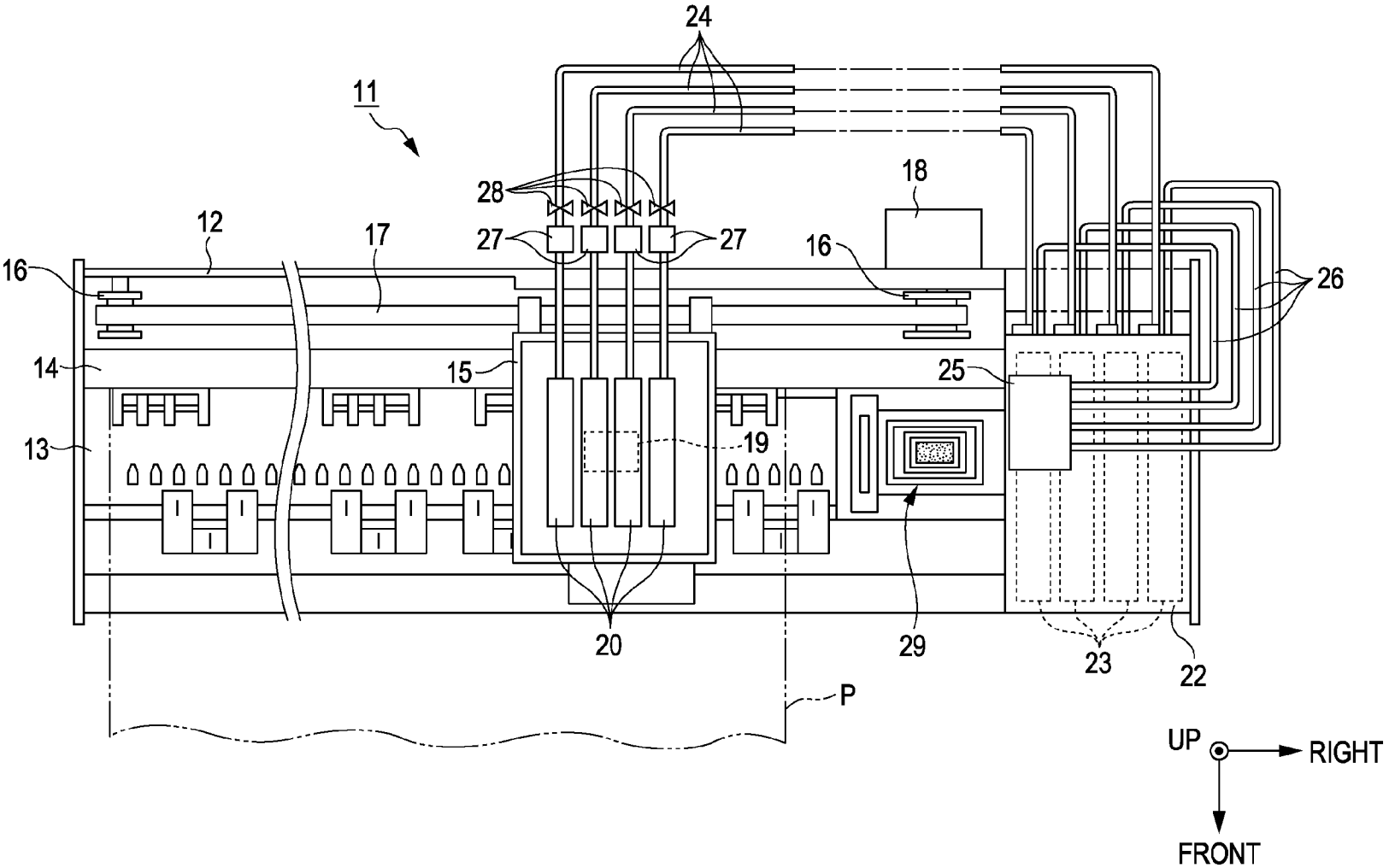
FIG. 1 is an overall plan view of a printer according to an embodiment.

Hereinafter, a specific embodiment of an ink jet printer, serving as a type of a liquid ejecting apparatus according to the invention, will be described with reference to FIGS. 1 through 4C. Note that in the following descriptions, the terms "depth direction", "vertical direction", and "horizontal direction" are assumed to refer to the "depth direction", "vertical direction", and "horizontal direction", respectively, illustrated by the arrows shown in the drawings, unless otherwise specified.

As shown in FIG. 1, a printer 11, serving as a liquid ejecting apparatus according to this embodiment, includes an approximately rectangular-box-shaped main body case 12. In the lower forward section within this main body case 12, a platen 13 is provided along the lengthwise direction of the main body case 12 (in FIG. 1, the horizontal direction), which also corresponds to the main scanning direction; recording paper P, serving as a recording medium, is transported upon this platen 13 by a paper feed mechanism (not shown), and is transported in the depth direction, which corresponds to the sub scanning direction. Meanwhile, a rod-shaped guide shaft 14 that extends parallel to the lengthwise direction (horizontal direction) of the platen 13 is provided above the platen 13 within the main body case 12.

A carriage 15 is supported by the guide shaft 14 so as to be capable of back-and-forth movement in the main scanning direction (the horizontal direction). The carriage 15 is linked, for driving, to a carriage motor 18 provided on the rear surface of the main body case 12, via an endless timing belt 17 that is stretched across a pair of pulleys 16 provided on the rear side surface of the main body case 12. Accordingly, the carriage 15 is moved back and forth in the main scanning direction along the guide shaft 14 as a result of driving carried out by the carriage motor 18.

A recording head 19, serving as a liquid ejecting head, is mounted on the bottom surface side of the carriage 15, opposing the platen 13. Meanwhile, multiple (in this embodiment, four) ink chambers 20, that temporarily hold and supply ink, serving as a liquid, to the recording head 19, are provided in the carriage 15 so as to correspond to the types (colors or the like) of inks used in the printer 11.

The bottom surface of the recording head 19 is configured as a horizontal nozzle formation surface 19*a* (see FIG. 3A) in which nozzle openings 21*a* for multiple nozzles 21 that eject ink (see FIG. 3A) are provided. Multiple nozzle rows (see FIG. 3A) in which the multiple nozzle openings 21*a* that eject the ink are disposed at equal intervals along the sub scanning direction (the depth direction), which also corresponds to the transport direction of the recording paper P, are disposed in the nozzle formation surface 19*a* so as to be parallel with each other at set intervals in the main scanning direction (the horizontal direction), which also corresponds to the lengthwise direction of the recording head 19. The recording head 19 records onto the surface of the recording paper P by ejecting ink as the recording paper P supplied upon the platen 13 passes underneath the recording head 19.

A box-shaped cartridge holder 22 is provided at one end (the right end in FIG. 1) of the main body case 12. Multiple (in this embodiment, four) ink cartridges 23 that hold different types (colors and the like) of the ink are mounted in the cartridge holder 22 in a removable state.

Furthermore, multiple (this embodiment, four) ink supply tubes 24 are connected to respective ink chambers in the carriage 15 at one end, and are connected to the cartridge holder 22 at the other end. When the respective ink cartridges 23 are mounted in the cartridge holder 22, the ink cartridges 23 communicate with respective ink chambers 20 via the ink supply tubes 24. When the recording head 19 consumes ink due to recording or the like, the ink within the respective ink cartridges 23 is supplied to the recording head 19 via the respective ink supply tubes 24 and the respective ink chambers 20.

Furthermore, a pump 25 for supplying pressurized air to the respective ink cartridges 23 is installed above the cartridge holder 22. The same number of air supply tubes 26 as there are ink cartridges that can be installed in and removed from the cartridge holder 22 (in this embodiment, four) are connected to the pump 25 at one end, and are connected to the cartridge holder 22 at the other end.

A pressurizing pump 27, serving as a pressurizing unit, and an on-off valve 28 are provided in each of the ink supply tubes 24, in a location midway therein. The on-off valve 28 is a valve that can be opened and closed as desired, and is provided immediately upstream from the pressurizing pump 27. A solenoid valve, a valve that operates mechanically, or the like can be employed as the on-off valve 28.

An area between the cartridge holder 22 and the platen 13 corresponds to a home position, which is a standby location for the carriage 15 when the printer 11 is turned off, the recording head 19 is undergoing maintenance, and so on. Furthermore, a maintenance apparatus 29 for cleaning the recording head 19 is provided in a location that is below the carriage 15 when the carriage 15 is located at the home position. The maintenance apparatus 29 prevents the nozzles 21 in the recording head 19 from drying, and is used when executing pressure cleaning that expels bubbles and the like from the nozzles 21 by pressurizing the ink within the ink supply tubes 24 using the pressurizing pump 27.

First, the pressurizing pump 27 will be described.

As shown in FIG. 2, the pressurizing pump 27 includes a flow channel member 31 of a certain standard shape. A first connection portion 32 that connects to the ink supply tube 24 on the upstream side is provided on the left end of the flow channel member 31, whereas a second connection portion 33 that connects to the ink supply tube 24 on the downstream side is provided on the right end of the flow channel member 31. A recessed portion 31*a*, which is circular in shape when viewed from above, is formed in the upper surface side of the flow channel member 31. An inflow channel 32*a* that allows the ink supply tube 24 on the upstream side to communicate with the recessed portion 31*a* is formed in the first connection portion 32. Meanwhile, an outflow channel 33*a* that allows the ink supply tube 24 on the downstream side to communicate with the recessed portion 31*a* is formed in the second connection portion 33.

A flexible film member 34 is affixed on the upper surface side of the flow channel member 31 in a flexible state so as to seal the opening of the recessed portion 31*a*. Meanwhile, a disk-shaped depression plate 35 that is smaller than the area of the opening of the recessed portion 31*a* is affixed approximately in the center of the outer surface side of the film member 34. A pressure chamber 36 is enclosed and formed by the film member 34 and the recessed portion 31*a*.

A biasing member 37 that biases the film member 34 in a direction that expands the interior volume of the pressure chamber 36 is disposed within the pressure chamber 36. The biasing member 37 can be configured from, for example, a coil spring, a plate spring, or the like. A cam member 38 that makes contact with the depression plate 35 is disposed above the depression plate 35. The cam member 38 is supported by a rotational shaft 39, and rotates along with the rotational shaft 39 in accordance with the driving of a first motor 40.

Figure 2A:
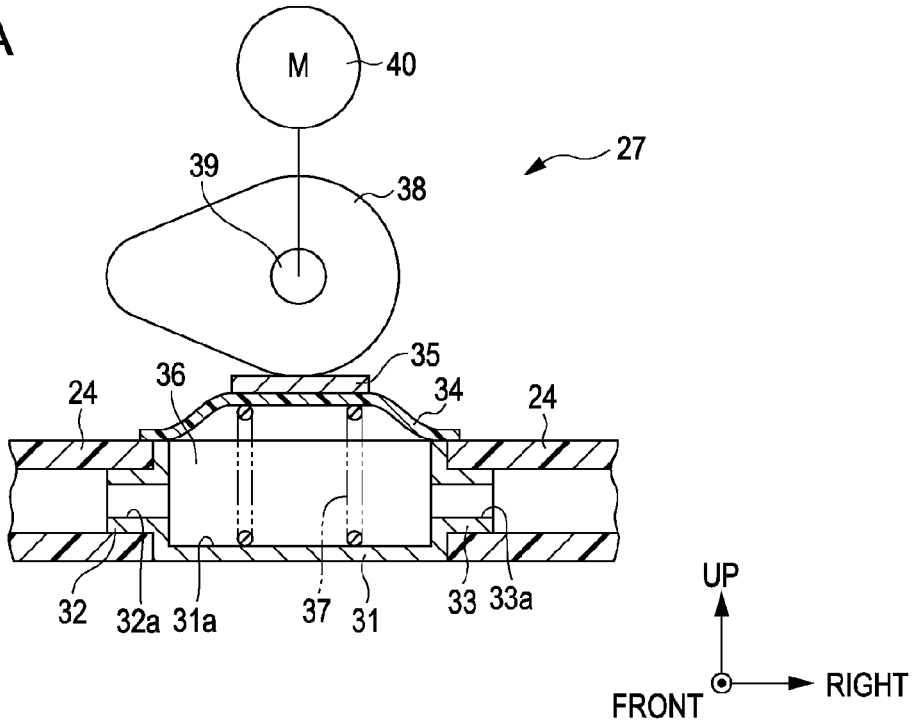
FIGS. 2A and 2B are overall cross-sectional views illustrating operations of a pressurizing pump, where
Figure 2B:
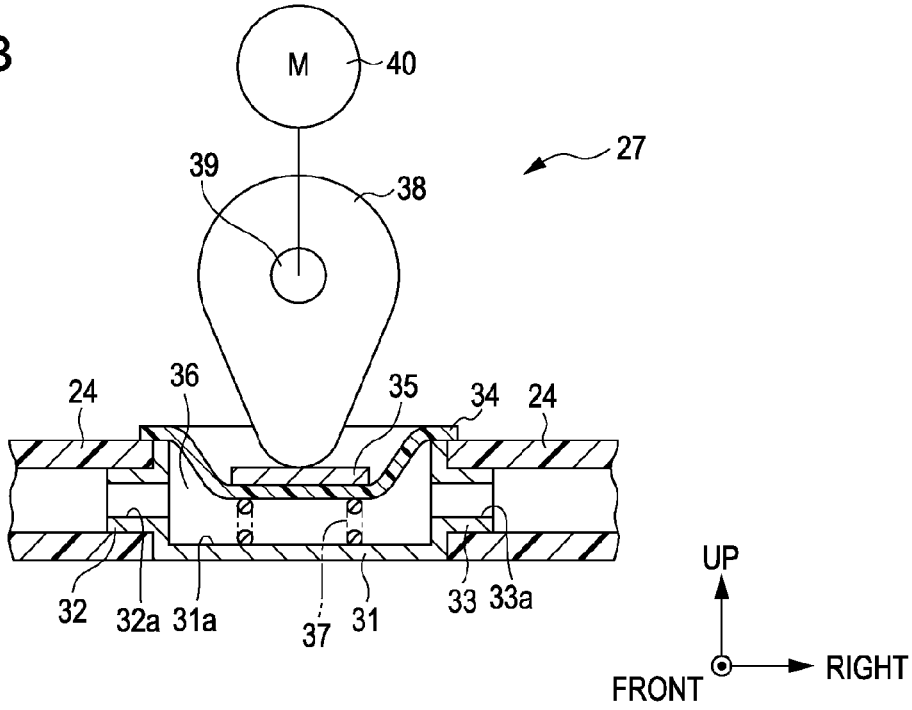

Accordingly, when the first motor 40 is driven in the forward direction in the state shown in FIG. 2A, the cam member 38 rotates in the counter-clockwise direction in FIG. 2A against the biasing force of the biasing member 37. As a result, as shown in FIG. 2B, the film member 34 displaces in a direction that reduces the interior volume of the pressure chamber 36, and the ink within the ink supply tube 24 is pressurized by the ink pushed out from the pressure chamber 36. Then, when the pressurizing pump 27 carries out pressurization, closing the on-off valve 28 located immediately upstream thereto ensures that the effects of the pressurization extend only downstream from the on-off valve 28.

Next, the maintenance apparatus 29 will be described.

Figure 3A:
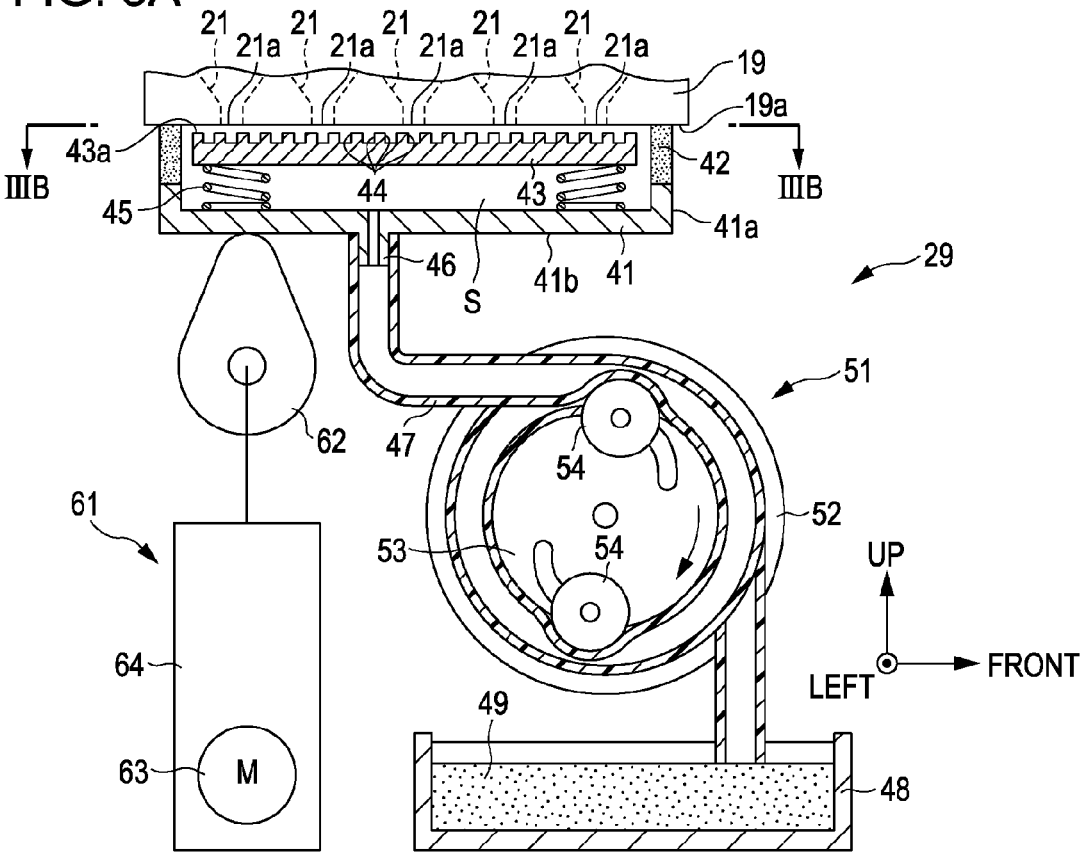
Figure 3B:
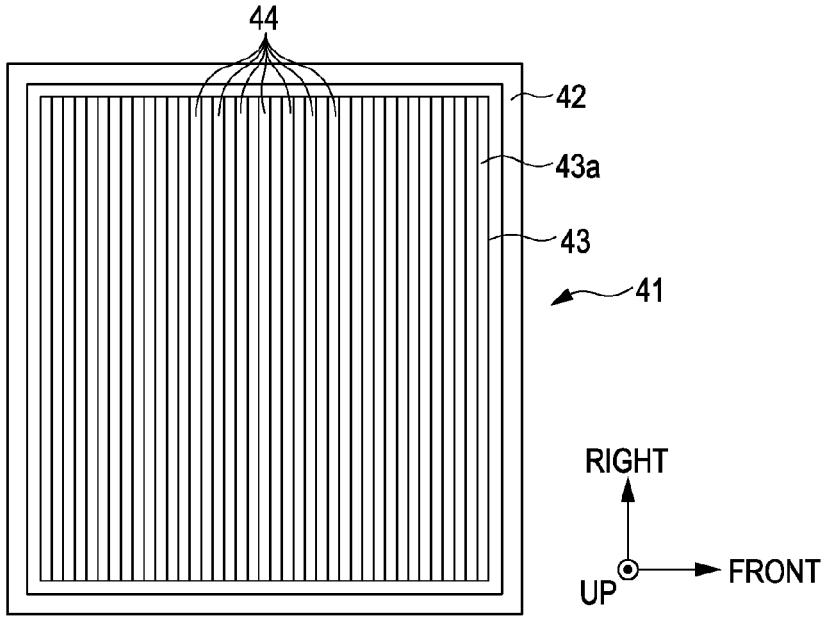
FIG. 3B is a plan view taken along the IIIB-IIIB line shown in FIG. 3A.

As shown in FIGS. 3A and 3B, the maintenance apparatus 29 includes an approximately square-box-shaped closed-ended cap member 41 whose upper side is open. A square frame-shaped sealing member 42 configured of a flexible material is disposed on the entire upper surface of a circumferential wall 41*a* of the cap member 41.

In addition, as shown in FIGS. 3A and 3B, a contact member 43, which is formed of an elastic member such as rubber and has an approximately rectangular shape when viewed from above, is disposed within the cap member 41 so as to oppose the nozzle formation surface 19*a* of the recording head 19 in the vertical direction. Multiple flow channels 44 whose cross-sections are rectangular in shape are formed in an upper surface 43*a* of the contact member 43, in line form extending in the direction that is orthogonal to the nozzle rows of the recording head 19 (in other words, the horizontal direction, which corresponds to the main scanning direction). In other words, the flow channels 44 are formed in the contact member 43 as grooves, both ends in the horizontal direction of which are open.

In this embodiment, the cross-sectional area of each of the flow channels 44 is less than the surface area of the nozzle openings 21*a* of the nozzles 21. In other words, in the case where the pressure loss of the flow channels 44 is compared with the pressure loss of the nozzles 21, the pressure loss of the flow channels 44 is greater than the pressure loss of the nozzles 21. Accordingly, the ink that is expelled from the nozzles 21 and flows into the flow channels 44 experiences a higher flow resistance in the flow channels 44 than in the case where the ink flows within the nozzles 21. Note that air is still allowed to pass even with the flow channels 44 whose pressure loss has been set to be great in this manner. Incidentally, in this embodiment, the size of the nozzle openings 21*a* is 20 to 50 μm, and the flow channels 44 are grooves that are smaller than this; accordingly, even if ink flows into the flow channels 44, the ink does not spread out across the grooves, and is instead held in the narrow grooves.

Meanwhile, the contact member 43 is supported upon a base wall 41*b* of the cap member 41 by coil springs 45. In this embodiment, the length of the coil springs 45 in an uncompressed state (that is, in a normal state) is set so that the upper surface 43*a* of the contact member 43 is disposed at a position that is lower than the tip end of the sealing member 42 in the cap member 41.

Furthermore, as shown in FIG. 3B, the dimension of the contact member 43 in the lengthwise direction (the horizontal direction) is shorter than the dimension of the cap member 41 in the lengthwise direction (the horizontal direction). In the case where the contact member 43 is disposed within the cap member 41, the circumferential wall 41*a* of the cap member 41 and the left and right side surfaces of the contact member 43 are distanced from each other. In other words, both ends of the flow channels 44 that are open on the left and right side surfaces of the contact member 43 stay in an open state.

When the contact member 43 is in contact with the nozzle formation surface 19*a* of the recording head 19, the openings of all of the nozzles 21 formed in the nozzle formation surface 19*a* of the recording head 19 are covered. Note that references to nozzle openings being covered in the aspects of the invention refer to this state. Here, in the case where the recording head 19, the contact member 43, or the like have changed form slightly, the nozzle formation surface 19*a* of the recording head 19 and the upper surface 43*a* of the contact member 43 are not in a tight state of surface contact; rather, a gap space region CS (see FIGS. 4A through 4C) is formed between the nozzle formation surface 19*a* and the upper surface 43*a*. This gap space region CS is formed by the upper surface 43*a* of the contact member 43 so that the pressure loss when ink has flowed in is greater than the pressure loss in the case where the nozzles 21 cause the ink to flow. In this manner, the upper surface 43*a* of the contact member 43 functions as a contact surface that makes contact with the nozzle formation surface 19*a*.

Meanwhile, a discharge pipe 46 for discharging ink from the cap member 41 is provided in approximately the center of the base wall 41*b* in the cap member 41 so as to protrude downward. One end (the upstream side) of a discharge tube 47 that is configured of a flexible member and that configures a tube pump 51 serving as a suction unit is connected to the discharge pipe 46. The other end of the discharge tube 47 (the downstream side) is inserted into a waste ink tank 48. The waste ink tank 48 contains a waste ink absorption member 49 that is composed of a porous material.

The tube pump 51 is disposed between the cap member 41 and the waste ink tank 48. The tube pump 51 includes, within an approximately cylindrical-shaped case 52, an intermediate section of the discharge tube 47, a rotating member 53 that rotates central to the axis of the case 52, and a pair of pressure rollers 54 that are capable of pressing upon the discharge tube 47 while moving along the inner circumferential surface of the case 52 when the rotating member 53 rotates. When the rotating member 53 is rotated in the forward direction (the clockwise direction indicated by the solid line arrow in FIG. 3A), the pressure rollers 54 rotate while stripping the intermediate section of the discharge tube 47 from the side of the cap member 41 (the upstream side) to the side of the waste ink tank 48 (the downstream side). Due to this rotation, the air within the discharge tube 47 is expelled, and thus the area in the discharge tube 47 that is upstream from the tube pump 51 is depressurized. The ink within the cap member 41 is sucked as a result. On the other hand, when the rotating member 53 is rotated in the reverse direction (the counter-clockwise direction in FIG. 3A), the state of depressurization within the discharge tube 47 is released.

The maintenance apparatus 29 further includes a raising/lowering mechanism 61 that raises and lowers the cap member 41 in the vertical direction. The raising/lowering mechanism 61 includes a cam member 62 that makes contact with the cap member 41 from below, a second motor 63 for rotating the cam member 62, and a driving force transmission mechanism 64. When the second motor 63 is driven in the forward direction, the cam member 62 is rotated by the driving force transmission mechanism 64, the cap member 41 rises, and the contact member 43 makes contact with the nozzle formation surface 19*a*.

Next, operations of the printer 11 configured in this manner will be described, paying particular attention to the operations carried out when bubbles are eliminated from the nozzles 21 of the recording head 19.

With the printer 11, missing dots and the like occur due to bubbles entering into the ink supply tubes 24 when the ink cartridges 23 are replaced, bubbles entering into the nozzles 21 from the openings of the nozzles 21, and so on. In order to suppress a drop in the recording quality caused by such missing dots, the printer 11 executes pressure cleaning using the maintenance apparatus 29.

First, when the pressure cleaning is commenced, the printer 11 moves the carriage 15 to the home position, which is in a region that is above the maintenance apparatus 29, and stops the carriage 15 at the home position. Next, the raising/lowering mechanism 61 raises the cap member 41 and causes the tip end of the sealing member 42 in the cap member 41 to come into contact with the nozzle formation surface 19*a*. Upon doing so, an airtight space region S is formed between the nozzle formation surface 19*a* and the cap member 41. Then, when the raising/lowering mechanism 61 causes the cap member 41 to rise further from that state, the tip end of the sealing member 42 is strongly pressurized against the nozzle formation surface 19*a*.

Figure 4A:
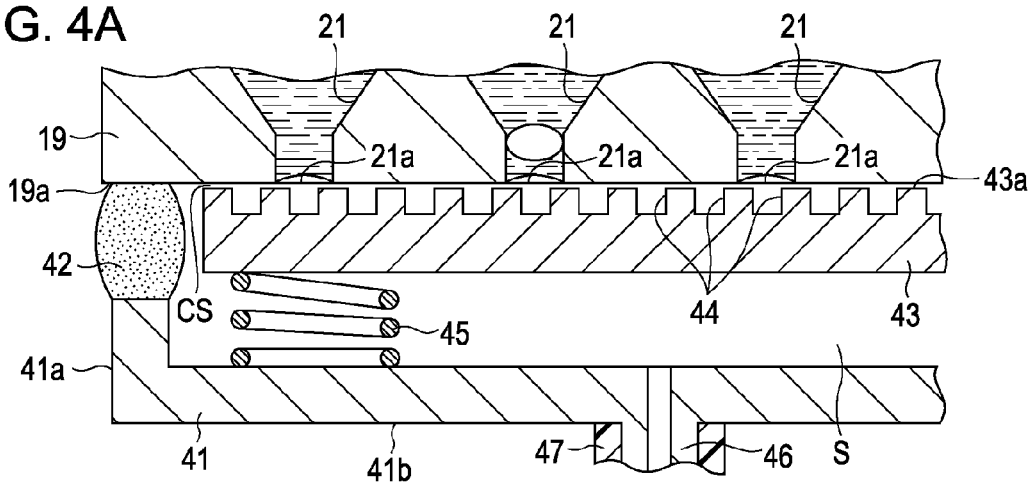
FIGS. 4A through 4C are schematic cross-sectional views illustrating effects of the maintenance apparatus on a recording head, where

This causes the sealing member 42 in the cap member 41 to be pressurized in the vertical direction, which in turn causes the sealing member 42 to be compressed by the nozzle formation surface 19*a*; accordingly, the base wall 41*b* of the cap member 41 approaches the nozzle formation surface 19*a*. As a result, as shown in FIG. 4A, the contact member 43 makes contact with the nozzle formation surface 19*a*, thus covering the nozzle openings 21*a* of the nozzles 21 that are formed in the nozzle formation surface 19*a*, in a state in which the contact member 43 is supported upon the base wall 41*b* of the cap member 41 by the coil springs 45 (a contact step). Here, in the case where the recording head 19, the contact member 43, or the like have changed form slightly, the gap space region CS is formed between the nozzle formation surface 19*a* of the recording head 19 and the upper surface 43*a* of the contact member 43.

Next, the recording head 19 is driven in a state in which the contact member 43 is in contact with the nozzle formation surface 19*a* of the recording head 19. Upon doing so, ink is discharged toward the flow channels 44 that correspond to respective properly-functioning nozzles 21 into which bubbles have not entered (the nozzles on both ends in FIGS. 4A through 4C) (a discharge step). At this time, because the flow channels 44 have a cross-sectional area that is smaller than that of the nozzles 21, the ink expelled from the properly-functioning nozzles 21 passes through the flow channels 44 corresponding to the nozzles 21, but not discharged, and remains within those flow channels 44. On the other hand, ink is not discharged from the nozzles into which bubbles have entered even if the recording head 19 is driven, and thus no ink flows into the flow channels 44. Accordingly, the flow channel resistance in the flow channels 44 in which expelled ink is present is greater than the flow channel resistance in the flow channels 44 in which no ink is present.

Next, the on-off valve 28 is closed, and the ink in the pressure chamber 36 is pushed in the discharge direction by driving the pressurizing pump 27. The ink that has been pushed out from the pressure chamber 36 by the pressurizing pump 27 is suppressed from flowing upstream, and instead flows downstream toward the recording head 19. Pressure is then applied to the ink within the nozzles 21 via the ink supply tubes 24 and the ink chambers 20, due to the ink pushed out from the pressure chamber 36. Then, as shown in FIG. 4B, ink is discharged from the properly-functioning nozzles 21 (the nozzles on both ends in FIGS. 4A through 4B), which are the nozzles 21 formed in the recording head 19 from which ink can be discharged easily, toward the opposing respective flow channels 44.

The ink discharged from the properly-functioning nozzles 21 attempts to flow (pass) to the left and right toward the ends of the flow channels 44 that oppose the respective nozzles 21, but because the ink that flowed into the flow channels 44 earlier in the discharge step remains, the pressure loss of the flow channels 44 is high. Accordingly, because the ink that attempts to flow within those flow channels 44 is subject to the flow channel resistance of the flow channels 44, the amount of ink that flows within the flow channels 44 (that is, passes) is regulated. For this reason, the discharge of ink from the properly-functioning nozzles 21 is suppressed.

Furthermore, in the case where the gap space region CS is formed between the nozzle formation surface 19*a* of the recording head 19 and the upper surface 43*a* of the contact member 43, the ink discharged from the properly-functioning nozzles 21 attempts to flow in a circular shape central to the corresponding nozzles 21 and spread throughout the gap space region CS. However, in this case, the pressure loss of the gap space region CS is greater than that of the nozzles 21, as is the case with the flow channels 44; accordingly, the amount of ink that flows through the gap space region CS is regulated, which in turn suppresses the discharge of ink from the properly-functioning nozzles 21.

Figure 4B:
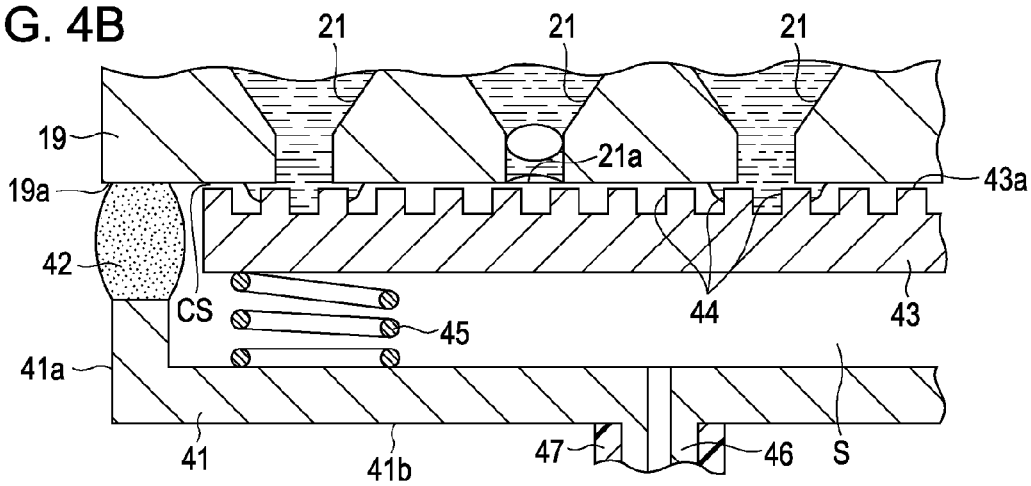
Figure 4C:
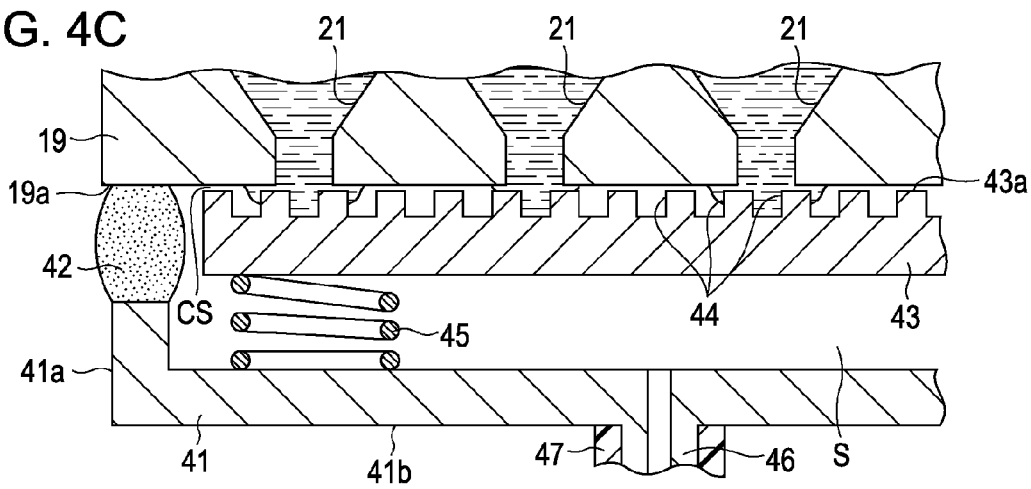

Here, because the method for pressurizing the nozzles 21 employs a constant amount of pressure, if the ink discharged from the properly-functioning nozzles 21 is suppressed, the pressure applied by the pressurizing pump 27 is synergistically concentrated on the flow channels having a lower pressure loss, or in other words, the nozzles 21 from which ink has not yet been expelled and into which bubbles have entered (the nozzles in the center in FIGS. 4A through 4C). As a result, as shown in FIG. 4C, a higher pressure is applied to the nozzles 21 into which bubbles have entered, and thus the bubbles inside are discharged along with the ink (a liquid discharge step). The bubbles (air) discharged from the nozzles 21 pass through the flow channels 44 and exit to the outside of the contact member 43. In these respects, the contact member 43 functions as a flow channel formation member that has the upper surface (a contact surface) 43*a*, which makes contact with the nozzle formation surface 19*a* so as to cover the nozzle openings 21*a*, and that has, formed therein, the flow channels 44, which are flow channels whose pressure loss is greater than that of the nozzles 21 and that allow air to pass therethrough. Because the discharged ink flows into the flow channels 44, the pressure loss increases, and the ink is suppressed from being discharged across all the nozzles. The on-off valve 28 is then opened, and the pressure cleaning ends.

When the pressure cleaning of the nozzles 21 in the recording head 19 ends in this manner, the raising/lowering mechanism 61 lowers the cap member 41 to its original position. After that, the inner space area of the cap member 41 undergoes dry suction, by driving the tube pump 51. Upon doing so, the ink that has flowed into and remains in the flow channels 44 of the contact member 43 is sucked from the openings on both ends of the flow channels 44 and is then discharged to the waste ink tank 48.

Meanwhile, in the case where it will be some time before the recording process is commenced (resumed) after the pressure cleaning of the nozzles 21 in the recording head 19 has ended, the cap member 41 is brought into contact with the nozzle formation surface 19*a* of the recording head 19 in a state in which the ink remains in the flow channels 44 of the contact member 43. Having ink present in the flow channels 44 makes it possible to prevent the ink in the nozzles 21 from drying, due to the moisture retention properties of the ink.

According to the embodiment described thus far, the following effects can be achieved.

When the ink within the nozzles 21 is pressurized in the discharge direction by the pressurizing pump 27 while the upper surface 43*a* of the contact member 43 is in contact with the nozzle formation surface 19*a*, first, the ink is discharged into the contact member 43 from the properly-functioning nozzles 21, after which the discharge of ink from the nozzles 21 into which bubbles have entered is carried out delaying by the amount of the bubbles. However, because the pressure loss in the flow channels 44 of the contact member 43 is greater than that of the nozzle openings 21*a* due to the inflow of ink, the flow of ink in the flow channels 44 that correspond to the properly-functioning nozzles 21 is regulated. Furthermore, because the pressure loss inside the nozzles 21 into which bubbles have entered is lower, the bubbles and ink within the nozzles 21 are discharged. In other words, the pressure from the pressurizing pump 27 can be concentrated on the ink within the nozzles 21 into which bubbles have entered. In addition, because the flow channels 44 formed in the contact member 43 are flow channels that allow air to pass therethrough, the bubbles pass through, whereas the ink adheres to the contact member 43 and the pressure loss increases. In other words, when the bubbles are discharged, the flow of ink is regulated. Accordingly, bubbles can be removed from the nozzles 21 of the recording head 19 with certainty while also suppressing the consumption of ink involved with cleaning.

With the pressurizing pump 27, the flow of ink is regulated, and thus the ink that has adhered to the contact member 43 cannot be discharged. However, the ink that remains within the flow channels 44 of the contact member 43 can be discharged with ease through the suction performed by the tube pump 51, which makes it possible to perform maintenance on the contact member 43.

Because the contact member 43 is disposed within the cap member 41, the airtight space region S can be formed by bringing the cap member 41 into contact with the recording head 19 in a state in which the contact member 43, which contains ink in the flow channels 44, is in contact with the nozzle formation surface 19*a* of the recording head 19. Accordingly, the interior of the nozzles 21 can be kept moist due to the ink contained in the flow channels 44 of the contact member 43, which makes it possible to prevent the nozzles 21 from drying out.

The pressure loss of the gap space region CS formed between the nozzle formation surface 19*a* and the upper surface 43*a* of the contact member 43 is greater than the pressure loss of the nozzles 21. Accordingly, even in the case where the gap space region CS is formed between the nozzle formation surface 19*a* of the recording head 19 and the upper surface 43*a* of the contact member 43, the pressure loss of the gap space region CS increases when the ink discharged from the nozzles 21 of the recording head 19 enters into the gap space region CS; this makes it possible to prevent the ink from passing through the gap space region CS. Accordingly, the wasteful consumption of ink can be suppressed without the ink that has been pressurized and discharged from the properly-functioning nozzles 21 leaking out from the gap space region CS. Furthermore, even if the nozzle formation surface 19*a* of the recording head 19, the contact member 43, and so on have changed shape slightly, a gap formed due to those two elements not coming into complete contact with each other and in which the pressure loss increases when ink enters is permitted, and thus the apparatus will not be rendered unusable due to malformations.

Expelling ink from the nozzles 21 that can expel ink through the driving of the recording head 19 in a step prior to the discharge of ink from the nozzles 21 performed by the pressurizing pump 27 makes it possible to increase the flow channel resistance of the flow channels 44 in the contact member 43 that correspond to the properly-functioning nozzles 21. Accordingly, bubbles can be eliminated from the nozzles 21 of the recording head 19 with certainty, without applying a high amount of pressure, while further suppressing the consumption of ink from the properly-functioning nozzles 21.

Note that the aforementioned embodiment may be modified as described hereinafter.

The printer 11 may be realized using a full-line type line head printer having a long liquid ejecting head, or a lateral printer, or a serial printer.

The on-off valve 28 need not be provided.

The shapes of the flow channels 44 are not limited to straight lines, and may instead be curved. Furthermore, the flow channels 44 are not limited to being formed in the direction orthogonal to the nozzle rows, and may instead be formed in the same direction as the nozzle rows. In this case, it is desirable for the flow channels not to be formed in positions corresponding to the openings of the nozzles 21.

The shapes of the flow channels 44 are not limited to rectangular cross-sectional shapes, and may be different shapes, such as cross-sectional U shapes, cross-sectional V-shapes, cross-sectional half-circles, and so on.

The flow channels 44 are not limited to grooves formed along the upper surface of the contact member 43, and may instead employ a form that allows passage into the contact member 43, such as a mesh shape, holes having smaller diameters than those of the nozzles, and so on. Furthermore, the contact member 43 is not limited to an elastic member such as rubber, and may instead be formed of a sponge, a sintered resin, a metal, melamine foam, a film, and so on.

The pressurizing unit is not limited to the pressurizing pump 27, and may instead be a tube pump, a pump that employs a solenoid clutch, or the like.

The contact member 43 is not limited to a member that is disposed within the cap member 41 upon the coil springs 45, and may instead be disposed within the cap member 41 without the coil springs 45. Furthermore, the contact member 43 may be provided at an end portion of the opening of the cap member 41.

The raising/lowering mechanism 61 need not be a constituent element of the maintenance apparatus 29.

The cap member 41 need not be a constituent element of the maintenance apparatus 29.

The tube pump 51 need not be a constituent element of the maintenance apparatus 29.

In the above embodiment, a liquid ejecting apparatus is embodied as the ink jet printer 11, but a liquid ejecting apparatus that ejects or expels another liquid aside from ink may be employed as well. The invention can also be applied in various types of liquid ejecting apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid phase, including liquids having high or low viscosity, sol, gel water, other inorganic solvent, organic solvent, liquid solutions, liquid resins, and fluid states such as liquid metals (metallic melts); furthermore, in addition to liquids as a single state of a matter, liquids in which the particles of a functional material composed of a solid matter such as pigments, metal particles, or the like are dissolved, dispersed, or mixed in a liquid solvent are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface light emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatuses that eject an etching liquid such as an acid or alkali onto a substrate or the like for etching. The invention can be applied to any type of these liquid ejecting apparatuses.

What is claimed is:

1. A maintenance apparatus, provided in a liquid ejecting apparatus including a liquid ejecting head having a nozzle capable of ejecting a liquid from a nozzle opening formed in a nozzle formation surface, that removes bubbles from within the nozzle, the maintenance apparatus comprising:

a pressurizing unit disposed upstream of the liquid ejecting head that pressurizes the liquid in the nozzle in a direction in which the liquid is discharged from the nozzle opening; and a flow channel formation member having a contact surface configured to cover the nozzle formation surface, and that has, formed therein, a flow channel whose cross-sectional area is smaller than the opening surface area of the nozzle opening and that allows air to pass through from the side of the contact surface, wherein the liquid within the nozzle and in a supply tube communicating the liquid to the nozzle is pressurized by the pressurizing unit in a state in which the flow channel formation member covers the nozzle formation surface so that the flow channel is opposed to the nozzle opening.

2. The maintenance apparatus according to claim 1, further comprising a suction unit that sucks the liquid from within the flow channel of the flow channel formation member.

3. The maintenance apparatus according to claim 1, further comprising:

a cap member that forms to enclose an airtight space between the cap member and the nozzle formation surface by making contact with the liquid ejecting head so as to surround the nozzle opening, wherein the flow channel formation member is disposed within the cap member.

4. The maintenance apparatus according to claim 1, wherein the contact surface of the flow channel formation member is configured so that the pressure loss of a gap space region is greater than the pressure loss of the nozzle.

5. A liquid ejecting apparatus comprising:

a liquid ejecting head having a nozzle capable of ejecting a liquid from a nozzle opening formed in a nozzle formation surface; and the maintenance apparatus according to claim 1.

6. A liquid ejecting apparatus comprising:

a liquid ejecting head having a nozzle capable of ejecting a liquid from a nozzle opening formed in a nozzle formation surface; and the maintenance apparatus according to claim 2.

7. A liquid ejecting apparatus comprising:

a liquid ejecting head having a nozzle capable of ejecting a liquid from a nozzle opening formed in a nozzle formation surface; and the maintenance apparatus according to claim 3.

8. A liquid ejecting apparatus comprising:

a liquid ejecting head having a nozzle capable of ejecting a liquid from a nozzle opening formed in a nozzle formation surface; and the maintenance apparatus according to claim 4.

9. A maintenance method for a liquid ejecting apparatus that includes a liquid ejecting head having a nozzle capable of ejecting a liquid from a nozzle opening formed in a nozzle formation surface and that employs a maintenance apparatus, the maintenance apparatus including a pressurizing unit that pressurizes the liquid in the nozzle of the liquid ejecting head in a direction in which the liquid is discharged from the nozzle opening and a flow channel formation member having a flow channel whose pressure loss is greater than the pressure loss of the nozzle and that allows air to pass through but regulates the passage of the liquid, and the method comprising:

bringing the flow channel formation member into contact with the nozzle formation surface so as to cover the nozzle opening;

following covering the nozzle opening, expelling the liquid from the nozzle by driving the liquid ejecting head; and discharging the liquid from the nozzle to the flow channel formation member by pressurizing the liquid within the nozzle using the pressurizing unit after the expelling.

* * * * *